US007119652B2

(12) United States Patent
Umeda

(10) Patent No.: US 7,119,652 B2
(45) Date of Patent: Oct. 10, 2006

(54) METHOD OF AVOIDING ARC PROLONGATION ON CURRENT INTERRUPTION, PARTICULARY A FUSE

(76) Inventor: Tadashi Umeda, 2-11-3 Matsudo cho, Hitachinaka C., Ibrakipref (JP)

( * ) Notice: Subject to any disclaimer, the term of this patent is extended or adjusted under 35 U.S.C. 154(b) by 55 days.

(21) Appl. No.: 10/603,854

(22) Filed: Jun. 26, 2003

(65) Prior Publication Data

US 2005/0040927 A1 Feb. 24, 2005

(30) Foreign Application Priority Data

Jul. 1, 2002 (JP) ..... 2002-226726

(51) Int. Cl.
*H01H 85/42* (2006.01)
*H01H 85/38* (2006.01)

(52) U.S. Cl. ..... 337/282; 337/273

(58) Field of Classification Search ..... 337/273–282, 337/290, 166, 186, 227, 228, 246, 248, 249, 337/250; 218/34–36, 40, 43, 46, 59, 68, 218/76, 77, 81, 103, 147–149, 155–158, 218/337

See application file for complete search history.

(56) References Cited

U.S. PATENT DOCUMENTS 569,373 A * 10/1896 Downes ..... 337/222
3,851,290 A * 11/1974 Stover et al. ..... 337/166
3,962,668 A * 6/1976 Knapp, Jr. ..... 337/228
4,471,185 A * 9/1984 Kinsinger ..... 218/53
4,697,055 A * 9/1987 Walter et al. ..... 218/68
4,851,806 A * 7/1989 Rohrer et al. ..... 337/231
4,904,977 A * 2/1990 Mahieu ..... 337/281
4,926,153 A * 5/1990 Gurevich ..... 337/273
5,262,750 A * 11/1993 Gurevich ..... 337/273
5,889,458 A * 3/1999 Nakamura ..... 337/159

* cited by examiner

*Primary Examiner*—Anatoly Vortman

(57) ABSTRACT

A fuse assembly is disclosed. The fuse assembly includes an electrically insulating hollow casing of a substantially rectangular parallelepiped shape in outline, a fuse element provided within the casing and supported by the casing, the casing having first and second spheroidal concaves provided therein for facilitating reflecting and converging of shock waves into focuses at the time when an arc discharge is generated due to blowing of the fuse element and the shock waves are then produced, the first and second spheroidal concaves being disposed side by side along a longitudinal direction of the casing and overlapping each other in the longitudinal direction of the casing in such a manner that inner foci of the concaves are overlapped with each other, and a pair of spaced apart electrodes provided at both ends of the casing, the fuse element being electrically connected to the spaced apart electrodes and bridged between the spaced apart electrodes.

2 Claims, 6 Drawing Sheets

···Prior Art···

*Electrical conditions during short circuit*

*a* pre-arcing period
*b* arcing period
*c* fuselink voltage
*d* source e.m.f.

···Prior Art···

···Prior Art···

Note: $P_1$ shows pressure before shock wave entered.

$P_5$ shows pressure after shock wave passed away.

METHOD OF AVOIDING ARC PROLONGATION ON CURRENT INTERRUPTION, PARTICULARY A FUSE

FIELD OF THE INVENTION

This invention relates to a fuse assembly that facilitates extinguishing of an arc discharge generated at the time when an overcurrent flows through a fuse element of the fuse assembly and the fuse element is then blown.

BACKGROUND OF THE INVENTION

As a fuse assembly, there is known a fuse assembly that comprises a hollow casing, a pair of spaced apart electrodes mounted to the casing, and a fuse link or fuse element disposed within the casing and bridged between the spaced apart electrodes. In such a fuse assembly, when an overcurrent, which ranges from several ten times to several hundred times larger than a rated value, flows through the fuse link, the fuse link is partially melted and then cut into two parts, and the current is resultantly cut off. At this time, an arc discharge is generated between the parts of the melted fuse link.

As the two parts of the fuse element are melted by heat generated due to the arc discharge, a gap between the two parts of the melted fuse element becomes larger. As a result, the arc discharge will be spontaneously extinguished. Also, it is well known to persons skilled in the art that if an alternating current source is employed as a power supply for associated electrical equipment, the arc discharge tends to easily extinguish at the time when an AC voltage becomes zero.

Moreover, there is known a fuse assembly including a case filled with arc-extinguishing medium such as quartz sand. In this case, when an overcurrent flows through a fuse element of the fuse assembly, the fuse element is partially melted and then cut into two parts, and an arc discharge is generated, metal vapor which is produced from melted metal of the fuse element heated due to the arc discharge is then deposited on the quartz sand. As a result, the arc discharge is cooled and then extinguished.

However, in the event of the fuse assembly being small-sized, it is hard to cause the arc discharge to be extinguished since an entire gap between electrodes of the fuse assembly is inevitably small and the fuse element is inevitably shorter. Therefore, in order to cause the arc discharge to be positively extinguished, a fuse element that is long in length is inevitably required, so that an entire fuse assembly inevitably becomes larger. However, such a fuse assembly is practically inconvenient, since it can not comply with demands on miniaturization of associated electrical equipment. Moreover, in a case where applied voltage is high, even if such a fuse element is employed, the arc discharge tends to continuously occur. Also, in a case where a direct current source is employed as a power supply for associated electrical equipment, voltage does not become zero, so that there is less chance of extinguishing of the arc discharge.

When the generation of the arc discharge is continued and the metal vapor is continuously produced from the melted fuse element, there is a possibility that the casing of the fuse assembly will be burst or the electrodes are blown since an internal pressure in the casing is elevated by the continuous metal vapor. In addition, there is a possibility that arc heating will bring about internal ignition of the casing and the arc discharge will bring about flashover. As a result, the associated electrical equipment will be finally damaged.

Meanwhile, it is well known to persons skilled in the art that when the metal vapor from the melted fuse element progresses and the internal pressure in the casing is increased, shock waves are generated in the casing. The inventor aimed at this fact and experimentally found that it was possible to cause an arc discharge to be positively extinguished by controlling the shock waves.

SUMMARY OF THE INVENTION

The present invention has been made with a view to overcoming the foregoing problems of the prior art fuse assemblies.

It is an object of the present invention to provide a fuse assembly which facilitates extinguishing of an arc discharge generated at the time when an overcurrent flows through a fuse element of the fuse assembly and the fuse element is then blown.

It is another object of the invention to provide such a fuse assembly as mentioned above, which is simple in construction and produced at a low cost.

In accordance with the present invention, there is provided a fuse assembly. The fuse assembly comprises an electrically insulating hollow casing of a substantially rectangular parallelepiped shape in outline, a fuse element provided within the casing and supported to the casing, the casing having first and second spheroidal concaves provided therein for facilitating reflecting and converging of shock waves into focuses at the time when an arc discharge is generated due to blowing of the fuse element and the shock waves are then produced, the first and second spheroidal concaves being disposed side by side along a longitudinal direction of the casing and partially overlapping each other in the longitudinal direction of the casing in such a manner that inner foci of the concaves are overlapped with each other, and a pair of spaced apart electrical electrodes provided at both ends of the casing, the fuse element being electrically connected to the spaced apart electrodes and bridged between the spaced apart electrodes.

Each of the first and second concaves may circumferentially polygonal surfaces disposed adjacent one another along the longitudinal direction of the casing.

BRIEF DESCRIPTION OF THE DRAWINGS

These and other objects and many of the attendant advantages of the present invention will be readily appreciated as the same becomes better understood by reference to the following detailed description when considered in conjunction with the accompanying drawings, in which like reference numerals denote the same parts throughout the Figures and wherein.

DETAILED DESCRIPTION

Figure 1:
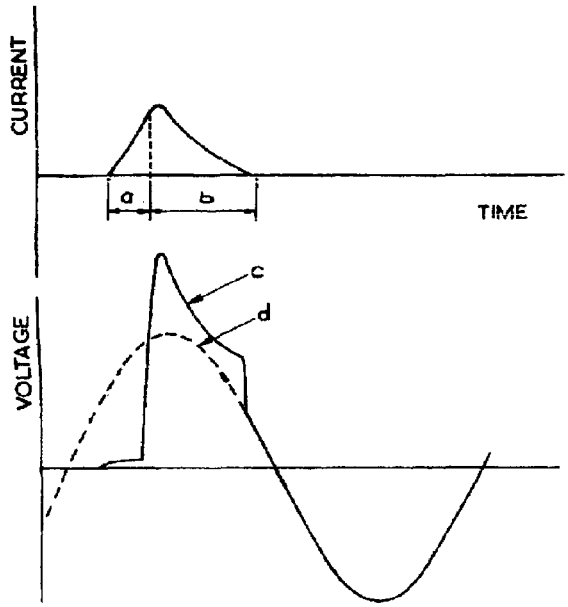
FIG. 1 is a graph that is of assistance in explaining a general behavior of an arc occurring immediately after a fuse element is blown due to an overcurrent flowing through the fuse element.

In order to facilitate understanding of the present invention, a general behavior of an arc discharge generated at the time when overcurrent flows through a fuse link of a fuse assembly and the fuse link is then melt or blown will be discussed hereinafter with reference to FIG. 1 that is disclosed in "Electric Fuses (1984), P. 38, A. Wright & P. G. Newbery, IEE, Power Engineering Series 2". FIG. 1 shows that, during a pre-arcing period "a", the current rises whereas the voltage across the fuse link is still low because the fuse link is not melted yet and sound. As shown in FIG. 1, at the end of the pre-arcing period "a", the fuse link voltage suddenly rises. This is brought about by fusing of the fuse link and the conductance of an associated circuit. That is, it is conceivable that an arc discharge will occur at the end of the pre-arcing period "a". Incidentally, it is known that metal of the fuse link is vaporized by only 40% of the metal at the end of the pre-arcing period "a". When the occurrence of the arc discharge is continued from the end of the pre-arcing period to a ¼ cycle of AC where AC voltage approaches zero as shown in FIG. 1, the fuse assembly may be damaged. Therefore, it is strongly requested that the arc discharge should be terminated as soon as the pre-arcing period "a" has elapsed.

Meanwhile, "Shock Wave (1998), Page 72, written by Kazuki Takayama and published by Ohmsha" describes that the arc discharge starting at the end of the period "a" brings about a sudden metal-evaporation of the fuse link metal at a substantially middle portion of an entire length of the fuse link, since after the period "a" has elapsed, the current goes stronger, the voltage goes higher, and arc heat generated due to the arc discharge is consequently high enough to melt the remainder of the fuse link explosively. As a result, pressure in a space of a fuse assembly casing in which the arc discharge is generated is increased, whereby shock waves are produced.

Figure 2:
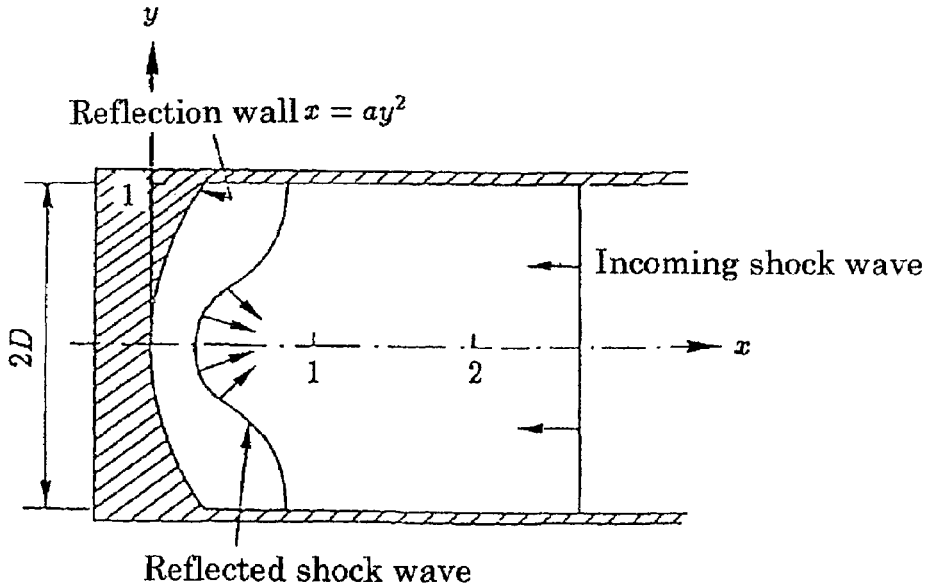
FIG. 2 is a schematic sectional view of a tube having an inner concave surface provided at a first end thereof, which is of assistance in explaining general behaviors of shock waves incident upon the concave surface from a second end of the tube, reflected by the concave surface and converged into a focus.

In order to further facilitate the understanding of the present invention, a general behavior of the generated shock waves will be discussed hereinafter with reference to FIG. 2 that is disclosed in "Shock Wave Handbook (1998), Page 87, edited by Kazuki Takayama and published by Spuringer Verlag Tokyo". FIG. 2 illustrates a cylindrical tube having a reflection wall provided at one end thereof. The reflection wall has an inner concave surface serving a reflecting mirror. FIG. 2 shows that shock waves which are incident from the other end of the cylindrical tube and travel toward the inner concave surface are reflected by the inner concave surface and then converged into a focus of the concave mirror. Incidentally, it is reported that, strictly speaking, the focus into which the shock waves are converged is not an optical focus but is an aerodynamic focus which is located closer to the concave mirror as compared with the optical focus. However, it is experimentally confirmed that the aerodynamic focus may be practically regarded as the optical focus.

Figure 3:
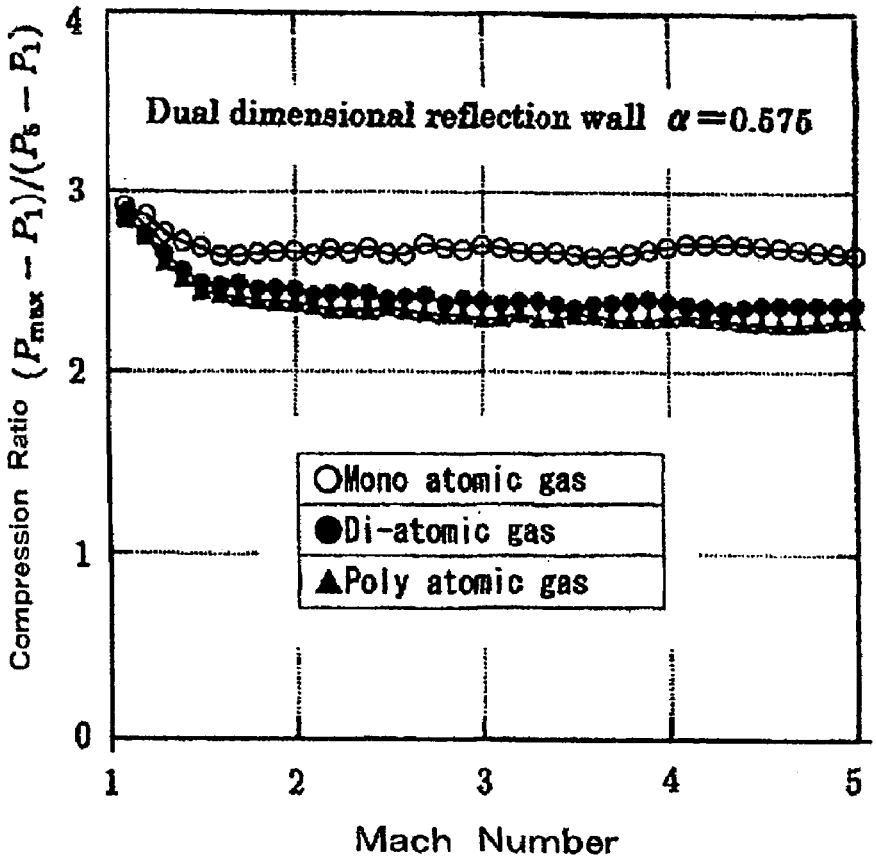
FIG. 3 is a graph that is of assistance in explaining change in atmospheric pressure at the focus of the shock waves.

At the focus into which the shock waves are converged, a diameter of the focused shock waves is infinitely condensed to zero, while energy of the focused shock waves is mostly maintained. Then, the density of the shock wave's energy is considerably increased. As a result, transferring speed of any medium in the tube, medium's pressure, and medium's temperature are elevated keenly. As shown in FIG. 3 that is disclosed at page 89 of the "Shock Wave Handbook (1998)", and described at pages 81–96 of it, especially an increase level of the medium's pressure at the focus reaches 2.3–3 times as large as original pressure of the shock waves independently of the Mach number of the generated shock waves. As described in "Ionization Phenomena in Gases (1969), Pages 199–210, edited by Denki Gakkai and published by Ohmsha", as to the necessary factors for arc-extinction, the atmospheric pressure is as important as the cooling of arc. Such an increase in the pressure brings about the extinction of arc.

First Embodiment

Figure 4:
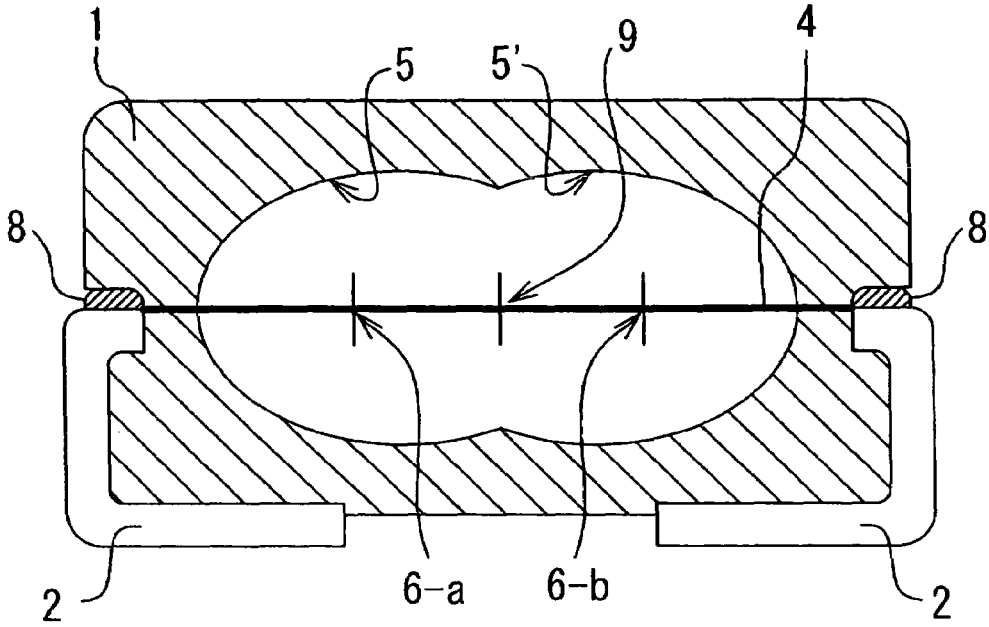
FIG. 4 is a schematic sectional view of a fuse assembly according to a first embodiment of the present invention, in which a fuse link of the fuse assembly is in a sound condition.
Figure 5:
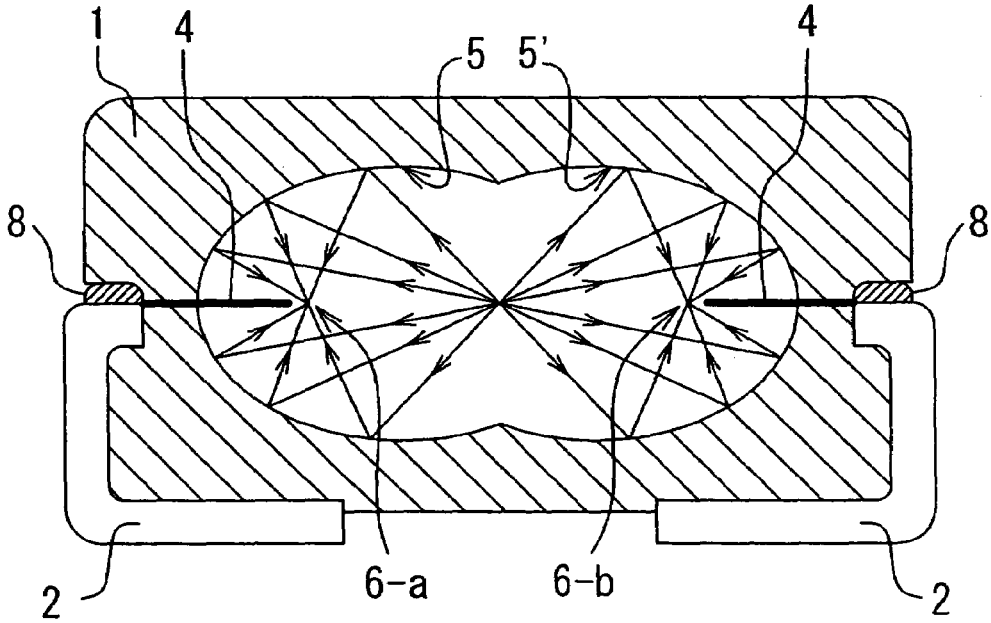
FIG. 5 is a schematic sectional view of the fuse assembly of FIG. 4, in which the fuse link is in a blown condition and which illustrates traces of shock waves produced due to an arc discharge.
Figure 6:
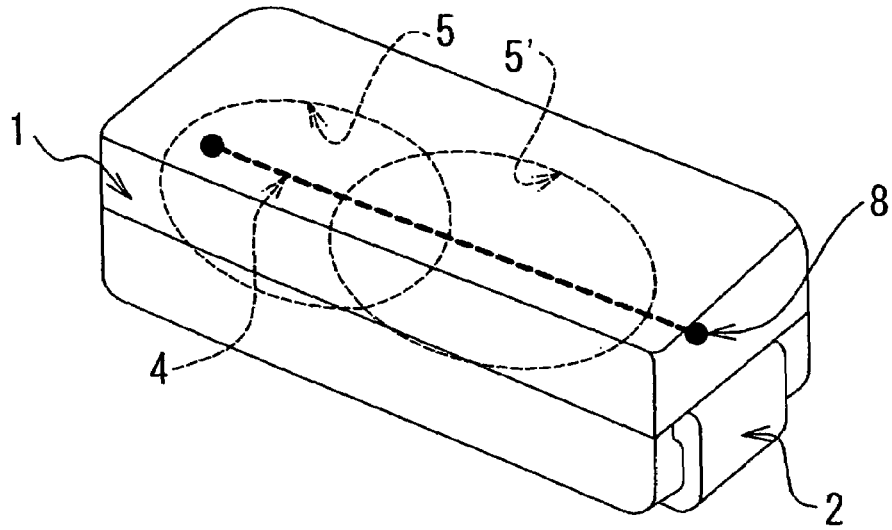
FIG. 6 is a schematic perspective view illustrating an appearance of the fuse assembly shown in FIG. 4.

Referring to FIGS. 4 to 6, there is illustrated a fuse assembly according to a first embodiment of the present invention. The fuse assembly includes an electrically insulating hollow casing 1 of a substantially rectangular parallelepiped shape in outline as shown in FIG. 6, and a fuse element or fuse link 4 provided in the casing 1 and supported by the casing 1. The electrically insulating casing 1 has first and second spheroidal concaves 5, 5' provided therein. The first and second spheroidal concaves 5, 5' are disposed side by side along a longitudinal direction of the electrically insulating casing 1 and partially overlap each other in the longitudinal direction of the casing 1 in such a manner that inner foci of the spheroidal concaves 5, 5' are overlapped with each other. The fuse assembly further includes a pair of spaced apart electrical conductors or electrodes 2 which are engaged with outer surfaces of opposite corners of the casing 1. The fuse link 4 is connected at both ends thereof to the electrical conductors 2 by solders 8 and bridged between the electrical conductors 2.

It is experimentally verified that, in a fuse assembly of this kind, when an overcurrent flows through a fuse link of the fuse assembly, the fuse link is melted or blown at a substantially middle point of a total length thereof and an arc discharge is generated at the substantially middle point of the fuse link. In the illustrated embodiment, in view of the above experimental fact, the first and second spheroidal concaves 5, 5' are designed so that the overlapped foci of the concaves 5, 5' are located at a substantially middle point 9 of the total length of the fuse link 4.

In the fuse assembly constructed as discussed above, when an overcurrent flows through the fuse link 4, the fuse link 4 is blown as shown in FIG. 5 and an arc discharge is generated, shock waves are generated at the substantially middle point 9 of the fuse link 4. The generated shock waves follow paths in indicated by arrows in FIG. 5 and are finally converged into points 6-*a*, 6-*b* More particularly, the shock waves starting from the point 9 travel toward surfaces of the first and second spheroidal concaves 5, 5', are then reflected by the surfaces of the first and second spheroidal concaves 5, 5', and finally converged into the points 6-*a*, 6*b*. The convergence of the shock waves brings about the extinction of the arc discharge.

Incidentally, the fuse assembly according to the first embodiment of the present invention is particularly suitable for a fuse assembly, such as a micro fuse assembly, which is provided with a fuse link that is short in length.

Figure 7:
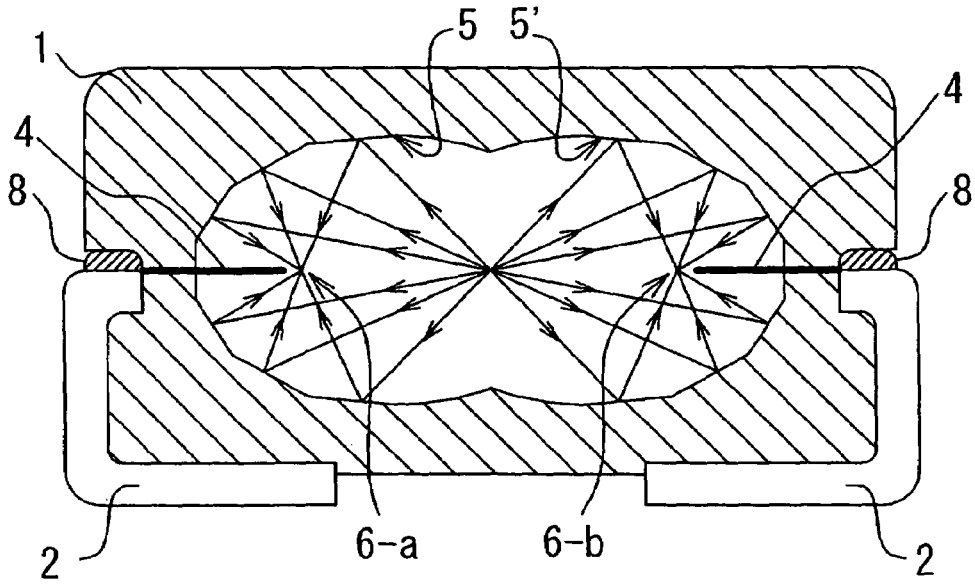
FIG. 7 is a schematic sectional view of a fuse assembly according to a modification of the first embodiment.
Figure 8:
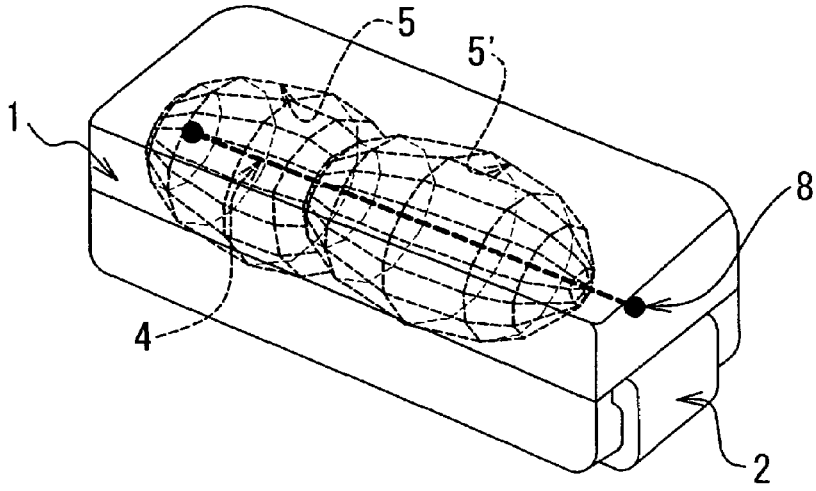
FIG. 8 is a schematic perspective view of the fuse assembly of FIG. 7.

Referring to FIGS. 7 and 8, there is illustrated a modification of the first embodiment. The modification of FIGS. 7 and 8 is substantially similar to the embodiment of FIGS. 4–6 except that each of the first and second spheroidal concaves 5, 5' has circumferentially polygonal surfaces disposed adjacent one another along the longitudinal direction of the casing 1.

Second Embodiment

Figure 9:
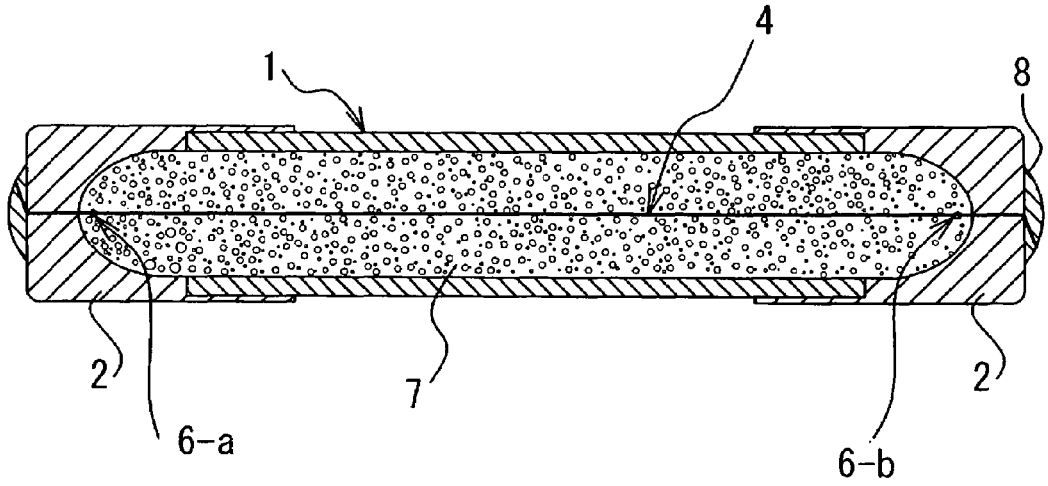
FIG. 9 is a schematic sectional view of a fuse assembly according to a second embodiment of the present invention.

Referring to FIG. 9, there is illustrated a fuse assembly according to a second embodiment of the present invention. The fuse assembly according to the second embodiment is different from the fuse assembly according to the first embodiment in that the casing 1 comprises a longitudinal tube, the spaced apart electrodes 2 are mounted on both ends of the longitudinal tube, arc-extinguishing medium 7, e.g., granular quartz or sand, is filled in a combination comprising the casing 1 and the electric conductors 2, and the first and second spheroidal concave 5, 5' are formed on inner surfaces of the electrodes 2.

In the embodiment of FIG. 9, when an arc discharge is generated at a substantially middle point of the fuse link 4, shock waves are generated at the substantially middle point of the fuse link 4, travel toward the spheroidal concaves 5, 5', and then reflected by the spheroidal concaves 5, 5'. The reflected shock waves are finally converged into points 6-*a*, 6-*b*. The convergence of the shock waves resultantly brings about the extinction of the arc discharge. Incidentally, in lieu of the spheroidal concaves of this embodiment, paraboloidal concaves or hyperboloidal concaves may be employed.

Figure 10:
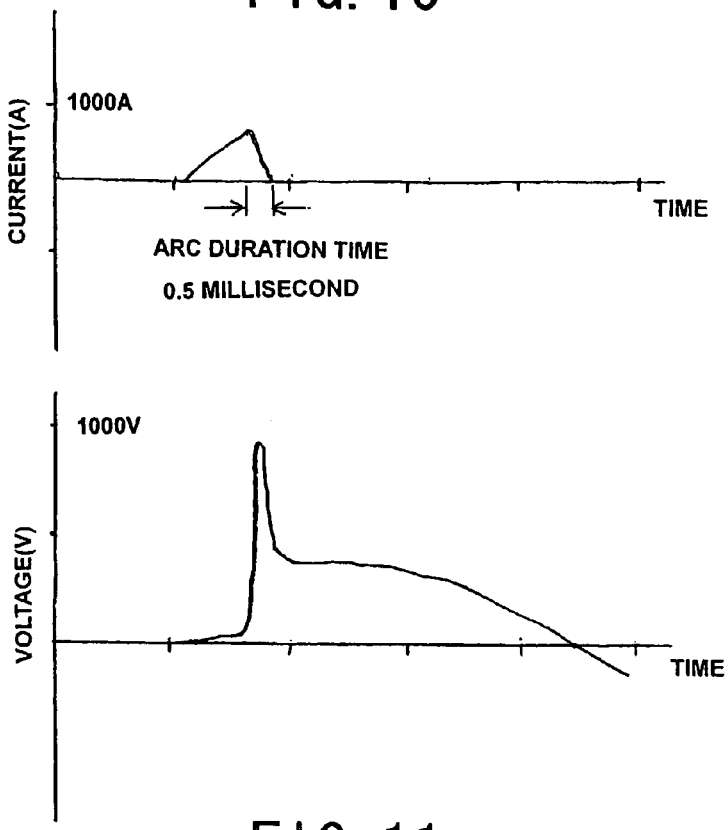
FIG. 10 is graphs showing current wave-form and voltage wave-form at the time of fusing of a fuse element of the fuse assembly shown in FIG. 9.
Figure 11:
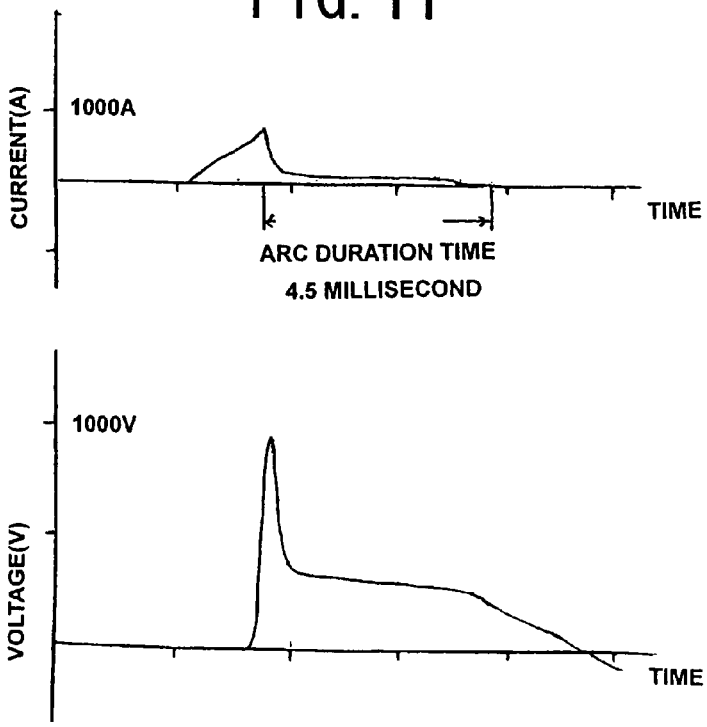
FIG. 11 is graphs showing current wave-form and voltage wave-form at the time of fusing of a fuse element of a conventional fuse assembly.

FIG. 10 is graphs exhibiting a current wave-form and a voltage wave-form at the time of fusing of the fuse link of the fuse assembly according to the second embodiment. FIG. 11 is graphs exhibiting a current wave-form and a voltage wave-form at the time of fusing of a fuse link of a conventional sand-filled fuse assembly. Comparison between the wave-forms illustrated in FIGS. 10 and 11 shows that the arcing time in the conventional fuse assembly is 4.5 milliseconds whereas the arcing time in the fuse assembly according to the second embodiment is 0.5 milliseconds and is considerably shortened as compared with the arcing time in the conventional fuse assembly. Therefore, in the fuse assembly according to the second embodiment, heat generation that is brought about by the arc discharge is suppressed, whereby the casing 1 and the electrodes 2 can be prevented from being damaged by the heat.

Shown in Table 1 are the results of breaking capacity test of the fuse assembly according to the second embodiment and the conventional fuse assembly. In Table 1, the cases where any explosion of the casing or damage of the electrodes is not brought about and the fuse link is normally blown are regarded as successful interruption.

TABLE 1

| Fuse Assembly | Number of Tested Assemblies | Duration of Arc Discharge (Milli-second) | Number of Successfully Interrupted Fuse Links | Percentage of Successfully Interrupted Fuse Links |
|---|---|---|---|---|
| Conventional Fuse Assembly | 30 | Average 4.5 | 11 | 37% |
| Fuse Assembly of second embodiment | 30 | Average 1.1 | 30 | 100% |

It can be seen from Table 1 that the fuse assembly according to the present invention provides good effects.

Third Embodiment

A fuse assembly according to a third embodiment of the present invention is substantially similar to the second embodiment except that a fuse link which is rated at 30 A is employed. This fuse assembly was subjected to a breaking capacity test where a direct voltage is 500V and a direct current is 1,000 A. The results of the breaking capacity test showed tranquil blowing of the fuse link of the third embodiment, since shock waves generated by an arc discharge are converged into the focuses, to thereby cause the arc discharge to be positively extinguished. On the other hand, a conventional fuse assembly which was subjected to the same breaking capacity test was broken.

It will be recognized by those skilled in the art that changes or modifications may be made to the above-described embodiments without departing from the broad inventive concepts of the invention. It is understood, therefore, that the invention is not limited to the particular embodiments which are described, but is intended to cover all modifications and changes within the scope and spirit of the invention as described above and set forth in the appended claims.

The invention claimed is:

1. A fuse assembly comprising:

an electrically insulating hollow casing of a substantially rectangular parallelepiped shape in outline;

a fuse element provided within said casing and supported by said casing;

said casing having first and second spheroidal concaves provided therein for facilitating reflecting and converging of shock waves into focuses at the time when an arc discharge is generated due to blowing of said fuse element and said shock waves are then produced;

said first and second spheroidal concaves being disposed side by side along a longitudinal direction of said casing and partially overlapping each other in the longitudinal direction of said casing in such a manner that inner foci of said concaves are overlapped with each other; and a pair of spaced apart electrodes provided at both ends of said casing;

said fuse element being electrically connected to said spaced apart electrodes and bridged between said spaced apart electrodes.

2. A fuse assembly according to claim 1, wherein each of said first and second concaves has circumferentially polygonal surfaces disposed adjacent one another along the longitudinal direction of the casing.

* * * * *